US010499784B2

(12) United States Patent
Hargett et al.

(10) Patent No.: US 10,499,784 B2
(45) Date of Patent: Dec. 10, 2019

(54) CLEANING ARTICLE HAVING DISCRETE SEAL BONDS

(71) Applicant: The Procter & Gamble Company, Cincinnati, OH (US)

(72) Inventors: Mark Mason Hargett, Liberty Township, OH (US); Gavin John Broad, Liberty Township, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 477 days.

(21) Appl. No.: 15/082,014

(22) Filed: Mar. 28, 2016

(65) Prior Publication Data

US 2016/0296094 A1 Oct. 13, 2016

(30) Foreign Application Priority Data

Apr. 9, 2015 (EP) ..... 15162895

(51) Int. Cl.
*A47L 13/38* (2006.01)
*A47L 13/16* (2006.01)
*A47L 13/20* (2006.01)

(52) U.S. Cl.
CPC ..... *A47L 13/16* (2013.01); *A47L 13/20* (2013.01); *A47L 13/38* (2013.01)

(58) Field of Classification Search
CPC ..... A47L 13/16; A47L 13/20; A47L 13/38
See application file for complete search history.

(56) References Cited

U.S. PATENT DOCUMENTS

| | | | | |
|---|---|---|---|---|
| 823,725 | A | 6/1906 | Hayden | |
| 4,145,787 | A | 3/1979 | Bastian | |
| 5,342,338 | A * | 8/1994 | Roe | A61F 13/511 604/358 |
| 5,953,784 | A | 9/1999 | Suzuki et al. | |
| 6,743,392 | B2 | 6/2004 | Tanaka et al. | |
| 6,813,801 | B2 | 11/2004 | Tanaka et al. | |
| 6,968,591 | B2 | 11/2005 | Tanaka | |
| 6,984,615 | B2 | 1/2006 | Kenmochi et al. | |
| 7,003,856 | B2 | 2/2006 | Hayashi et al. | |
| 7,228,587 | B2 | 6/2007 | Tanaka et al. | |
| 7,231,685 | B2 | 6/2007 | Tanaka et al. | |
| 7,234,193 | B2 | 6/2007 | Tanaka et al. | |

(Continued)

FOREIGN PATENT DOCUMENTS

| | | | |
|---|---|---|---|
| EP | 1731076 | A1 | 12/2006 |
| EP | 2283758 | A1 | 2/2011 |
| WO | WO 2012/099076 | A1 | 7/2012 |

OTHER PUBLICATIONS

EP Search Report Application No. 15162895.5-1712; 5 Pages; dated Sep. 24, 2015.

*Primary Examiner* — Shay Karls
(74) *Attorney, Agent, or Firm* — John T. Dipre

(57) ABSTRACT

A cleaning article having a layer of tow fibers and a layer of sheet material, joined together in a laminated construction. The layer of tow fibers and the sheet may be joined together at a spine. The spine is a seal between the adjacent, superimposed layer(s) of fibers and sheet(s). The seal comprises a plurality of individual bonds. The bonds overlap in the longitudinal direction and optionally in the transverse direction. This arrangement provides, at least, the benefit of less instantaneous energy draw when forming the seal using thermal bonding.

15 Claims, 5 Drawing Sheets

(56) References Cited

U.S. PATENT DOCUMENTS

| | | | | |
|---|---|---|---|---|
| 7,234,914 | B2 | 6/2007 | Tanaka et al. | |
| 7,237,296 | B2 | 7/2007 | Tanaka et al. | |
| 7,237,297 | B2 | 7/2007 | Tanaka et al. | |
| 7,243,391 | B2 | 7/2007 | Tanaka et al. | |
| 7,251,851 | B2 | 8/2007 | Lin et al. | |
| 7,302,729 | B2 | 12/2007 | Tanaka et al. | |
| 7,302,730 | B2 | 12/2007 | Tanaka et al. | |
| 7,334,287 | B2 | 2/2008 | Tanaka et al. | |
| 7,566,671 | B2 | 7/2009 | Hoadley et al. | |
| 7,779,502 | B2 | 8/2010 | Fujiwara et al. | |
| 7,803,726 | B2 | 9/2010 | Policicchio et al. | |
| 7,930,794 | B2 | 4/2011 | Tsutanaga et al. | |
| 7,937,797 | B2 * | 5/2011 | Tsuchiya | A47L 13/46 15/209.1 |
| 8,151,402 | B2 | 4/2012 | Takabay et al. | |
| 8,161,594 | B2 | 4/2012 | Policicchio et al. | |
| 8,186,001 | B2 | 5/2012 | Tsuchiya et al. | |
| 8,245,349 | B2 * | 8/2012 | Tsuchiya | A47L 13/38 15/226 |
| 8,528,181 | B2 | 9/2013 | Maurell et al. | |
| 8,756,746 | B2 | 6/2014 | Policicchio | |
| 8,763,197 | B2 | 7/2014 | Policicchio et al. | |
| 8,893,345 | B2 | 11/2014 | Cooper | |
| 9,113,768 | B2 * | 8/2015 | Wada | A47L 13/20 |
| 2007/0212157 | A1 | 9/2007 | Hoadley et al. | |
| 2013/0232706 | A1 | 9/2013 | Policicchio | |
| 2013/0232710 | A1 | 9/2013 | Policicchio | |
| 2014/0224698 | A1 | 8/2014 | Policicchio | |
| 2014/0225291 | A1 | 8/2014 | Broad et al. | |

* cited by examiner

CLEANING ARTICLE HAVING DISCRETE SEAL BONDS

FIELD OF THE INVENTION

The present invention relates to cleaning articles, more particularly to cleaning articles comprising tow fibers bonded to sheets and more particularly to a construction of cleaning articles typically referred to as dusters.

BACKGROUND OF THE INVENTION

Various cleaning articles have been created for dusting and light cleaning. For example, cloth rags and paper towels used dry or wetted with polishing and cleaning compositions have been used on relatively flat surfaces. But, rags and paper towels are problematic for reasons such as hygiene (the user's hand may touch chemicals, dirt or the surface during cleaning), reach (it may be difficult to insert the user's hand with the rag or paper towel into hard-to-reach places) and inconvenience (cleaning between closely-spaced articles typically requires moving the articles).

To overcome the problems associated with using rags and paper towels, various dust gathering devices having feathers, lamb's wool, and synthetic fiber brushes have been utilized for more than a century, as illustrated by U.S. Pat. No. 823,725 issued in 1906 to Hayden. Such dust gathering devices can be expensive to manufacture, and as such are designed to be cleaned and reused. One problem associated with a reusable dust gathering device is that such dust gathering devices may not hold or trap dust very well. Soiled, reusable devices are typically cleaned via shaking or through other mechanical agitation. This process is not entirely satisfactory as it requires an extra step during, interrupting and/or following the cleaning process. Furthermore, the attempted restoration of the device may not be successful, allowing redeposition of the previously collected dust.

To address the problems experienced with reusable dust gathering devices, disposable cleaning articles have been developed which have limited re-usability. The cleaning article may be used for one job (several square meters of surface) and discarded as being disposable, or may be restored and re-used for more jobs, then discarded. Traditional cleaning articles including feather dusters, cloths, string mops, strip mops and the like, are not disposable for purposes of this invention.

These disposable cleaning articles may include brush portions made of synthetic fiber bundles, called tow fibers, attached to a sheet as shown in U.S. Pat. No. 8,528,151. The tow fibers and sheets in such articles may be bonded together as disclosed in U.S. Pat. Nos. 7,712,578; 7,566,671; 7,779,502; 7,937,797; 8,151,402; 8161594, 8,186,001 and 8,245,349. Or the tow fibers may be attached to a plate as shown in U.S. Pat. No. 4,145,787. The cleaning articles may be manufactured using the processes disclosed in U.S. Pat. Nos. 6,743,392 and/or 7,003,856.

Such cleaning articles, are often referred to as dusters, and may be made, for example, according to U.S. Pat. Nos. 6,813,801; 6,968,591; 6,984,615; 7,228,587; 7,231,685; 7,234,193; 7,234,914; 7,237,296; 7,237,297; 7,243,391; 7302729; 7,302,730; and/or 7,334,287 (having a common related application). The patents in this linage have a common feature—strips laterally extending from both sides of a generally planar article. U.S. Pat. No. 5,953,784 teaches strips extending not only from both sides of the article, but also from the front of the article. Other geometries include U.S. Pat. No. 7,566,671 which does not use laterally extending strips but cleans only from one side of the implement. U.S. Pat. Nos. 7,251,851 and 7,930,794 teach a handle for a duster and having a spiral configuration. Dusters which advantageously do not require gather strips are shown in commonly assigned: 2013/0232710A1 having differential overhang between the sheet and fibers; U.S. Pat. No. 8,893,345 having a sheet with apertures; U.S. Pat. No. 8,756,746 having an elastically contracted sheet; and 2013/0232706A1, having an elastically contracted upstanding panel or simply a non-planar structure, as disclosed in commonly assigned U.S. Pat. No. 8,763,197. The duster may provide for wetting as disclosed in commonly assigned U.S. Pat. No. 7,803,726.

A feature common to each of these varied and different constructions is joining of the tow fibers and sheets. Generally the sheet(s) provide a chassis to hold and contain the tow fibers. If fibers are not securely captured, by being joined to the sheet, tow fibers may dislodge and remain on the cleaning surface. Such residual tow fibers are undesired and often perceived as debris—which must be, yet, further cleaned. The cleaning process is thereby undesirably extended—by the very article used in the initial cleaning process.

This situation may be exacerbated by the packaging. Such cleaning articles are typically packaged in a flat state, but may be drawn through a dispensing aperture as disclosed in commonly assigned US 2014/0224698. Tow fibers may snag during dispensing, before the user even begins the cleaning process. These fibers may become loose and be the source of more cleaning.

Once dispensed, the situation may be exacerbated by the package instructions. To get optimum performance, a user should pre-fluff the cleaning article prior to use. Fluffing, as defined herein, is the process of increasing the apparent volume of the cleaning article without adding material to the cleaning article. Often the packaging instructs the user to fluff the duster prior to use. Or a cleaning article may be fluffed during manufacture, as disclosed in commonly assigned US 2014/0225291. The disruption to the tow fibers during fluffing, at either point of use or during manufacture, may cause even more tow fibers to become dislodged from the sheet. Again, the dislodged tow fibers may require even more cleaning to be done to account for tow fibers no longer attached to the sheet.

Thus, there is a need for a cleaning article which provides for secure attachment of tow fibers to a sheet and particularly to a nonwoven sheet. There is likewise a need for a manufacturing process/apparatus which provides for secure attachment of tow fibers to a sheet and particularly to a nonwoven sheet, such as may particularly, but not exclusively, occur through ultrasonic bonding.

SUMMARY OF THE INVENTION

The invention comprises a cleaning article having a laminate construction comprising at least one fibrous layer and least one sheet. The laminae are joined together by a seal comprising discrete bonds.

DETAILED DESCRIPTION OF THE INVENTION

Figure 1:
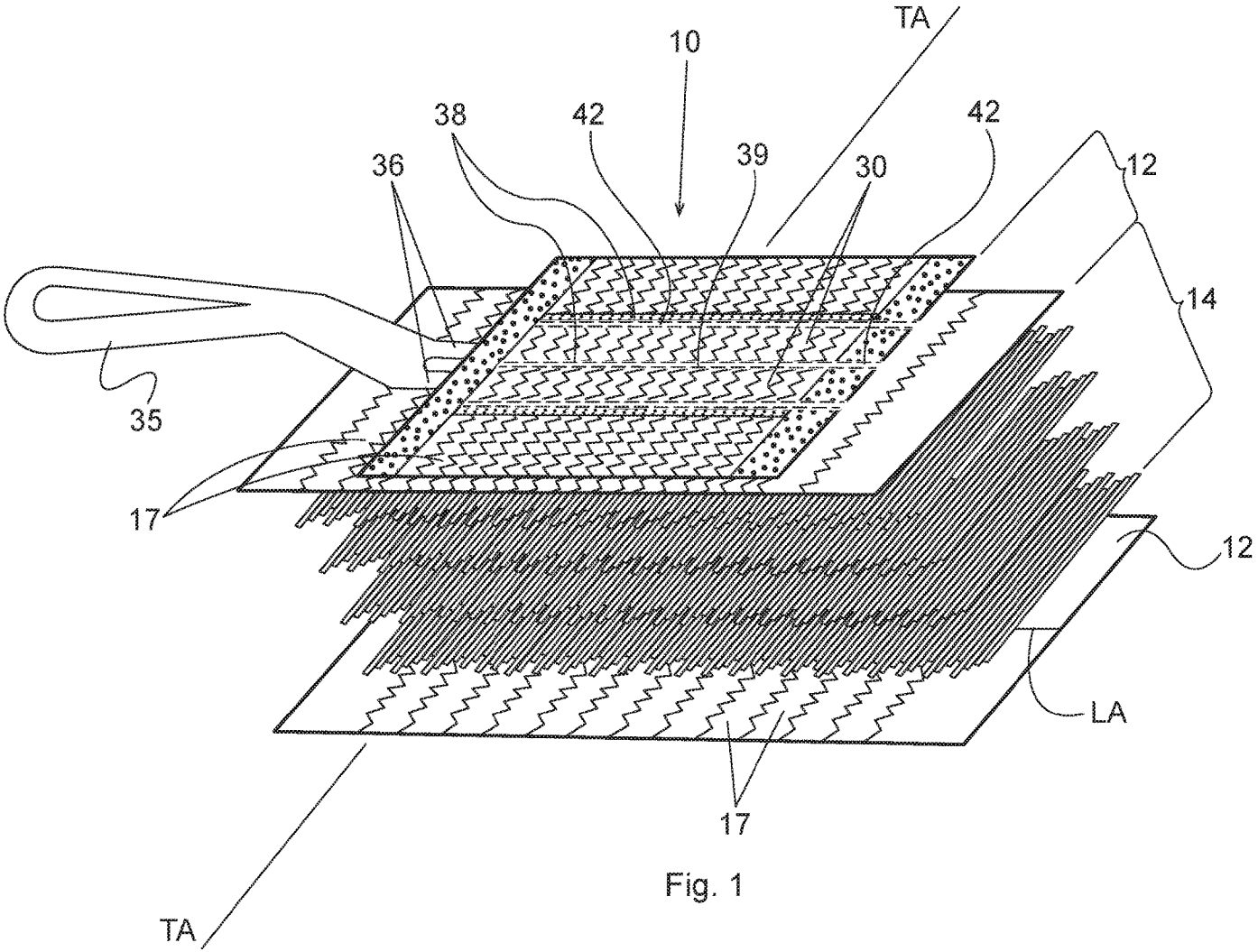
FIG. 1 is a schematic exploded perspective view of a cleaning article according to the present invention and having an optional handle.

Referring to FIG. 1, the cleaning article 10 may be generally elongate, having a longitudinal axis LA, although other shapes are contemplated and feasible. The cleaning article 10 comprises one or more fibrous layers 14 joined in laminate form to one or more sheets 12, by a seal 39 comprising a plurality of individual, discrete, spot bonds 38.

These cleaning articles 10 are typically referred to as dusters. The cleaning article 10 may be removably attachable to a handle 35 and/or may be used without a handle 35. A suitable handle 35 is disclosed in commonly assigned U.S. Pat. No. 8,578,564.

The z-direction of the cleaning article 10 is the direction perpendicular to the sheet 12 which is typically closest to the handle 35 (if present) of the cleaning article 10, the XY plane is defined as the plane defined by the sheet 12 and is typically perpendicular to the z-direction. The cleaning article 10 may have a longitudinal axis LA and a transverse axis TA orthogonal thereto. The cleaning article 10, and respective components thereof, may have two longitudinal edges 20 parallel to the longitudinal axis LA and two transverse edges 22 parallel to the transverse axis TA.

The length of the cleaning article 10, and of the handle 35 are taken in the longitudinal direction. The width of the cleaning article 10 corresponds to the transverse direction perpendicular to the length direction and disposed within the plane of the sheet 12. The thickness is defined as the dimension in the z-direction. The length and width of the strips shown in the art are taken in the transverse and longitudinal directions, respectively.

The cleaning article 10 may be thought of as having two, three or more laminae joined in face-to-face relationship. The laminae may comprise a tow fiber lamina 14, intermediate two laminae of generally planar sheets 12. Alternatively, a single tow fiber layer 14 may be joined to a single generally planar sheet 12. The tow fiber layer 14 is shown to comprise four layers, although one of skill will understand from one to several layers are feasible and contemplated for use with the present invention. Likewise, one, two, three or more sheets 12 are feasible and contemplated for use with the present invention.

The sheet(s) 12 and tow fiber layer(s) 14 may be joined by a plurality of bonds 38, as set forth below. The bonds 38 may be thermal, adhesive or ultrasonic, etc. as are known in the art.

The cleaning article 10 may optionally further comprise gather strips 17, as known from the prior art. As used herein, gather strips 17 refer to cantilevered elements extending transversely outwardly from the longitudinal centerline of the article 10, and having a length (taken in the transverse direction) greater than the corresponding width (as taken in the longitudinal direction). The gather strips 17 lie within the XY plane as intended by manufacture, although may be deformed out of the XY plane due to fluffing before use, and/or deformations which occur in use due to movement against the target surface. The gather strips 17 may be incorporated into one of the sheets 12 described above or may be deployed on a separate sheet 12. The gather strips 17 may be incorporated on an outermost portion of the tow fiber bundle 14, be incorporated between tow fiber bundle layers 14 and/or combinations thereof.

An attachment system may provide for removable attachment of the cleaning article 10 to a suitable and optional handle 35. The cleaning article 10 attachment system and optional complementary handle 35 attachment may comprise adhesive joining, cohesive joining, mechanical engagement, etc. One common attachment system comprises sleeves 30 into which the tine 36 or tines 36 of the handle 35 may be inserted. The sleeves 30 may be disposed on an outer lamina 12 and may be formed by one or more seals, as described herein below.

The sheet 12 may have an outwardly facing preferential cleaning side and a second inwardly facing attachment side opposed thereto. The sheet 12 may comprise a nonwoven sheet 12. Suitable nonwovens may be made according to commonly assigned U.S. Pat. Nos. 6,797,357; 6,936,330, D489,537 and/or D499,887. The sheet 12 may comprise two or more plies, joined together in face-to-face relationship.

Adjacent the sheet 12 may be a compressible and/or deformable second lamina of fibers 14. The second lamina may comprise tow fibers 14. The tow fiber lamina 14 may be joined to the sheet 12 in face-to-face relationship. The tow fiber lamina 14 may be suitable for directly contacting the target surface during cleaning.

The tow fibers 14 may be synthetic. As used herein "bundle fibers" and/or "tow" refer to fibers comprising synthetic polymers including polyester, polypropylene, polyethylene, bio-derived polymers such as polylactic acid, bio-polyethylene, bio-polyester and the like. Tow fibers 14 also include fibers from natural sources such as cellulose, cellulose acetate, flax, hemp, jute and mixtures thereof manufactured wherein the individual fibers are relatively long strands manufactured in bundles. The bundle fibers may be defined as any fibers having distinct end points and at least about 1 cm in length. The tow fibers 14 may extend continuously and in a substantially transverse direction, between the transverse edges of the article 10. The cleaning article 10 of the present invention may further comprise an optional absorbent core (not shown).

The sheet(s) 12 and tow fiber layer(s) 14 may be joined by a plurality of permanent bonds 38. The bonds 38 are intended to minimize or prevent stray or dislodged tow fibers 14 from becoming loose. Such sheet(s) 12 and tow fiber layer(s) 14 may typically be directly superimposed on one another, without intervening members or components therebetween.

Figure 1A:
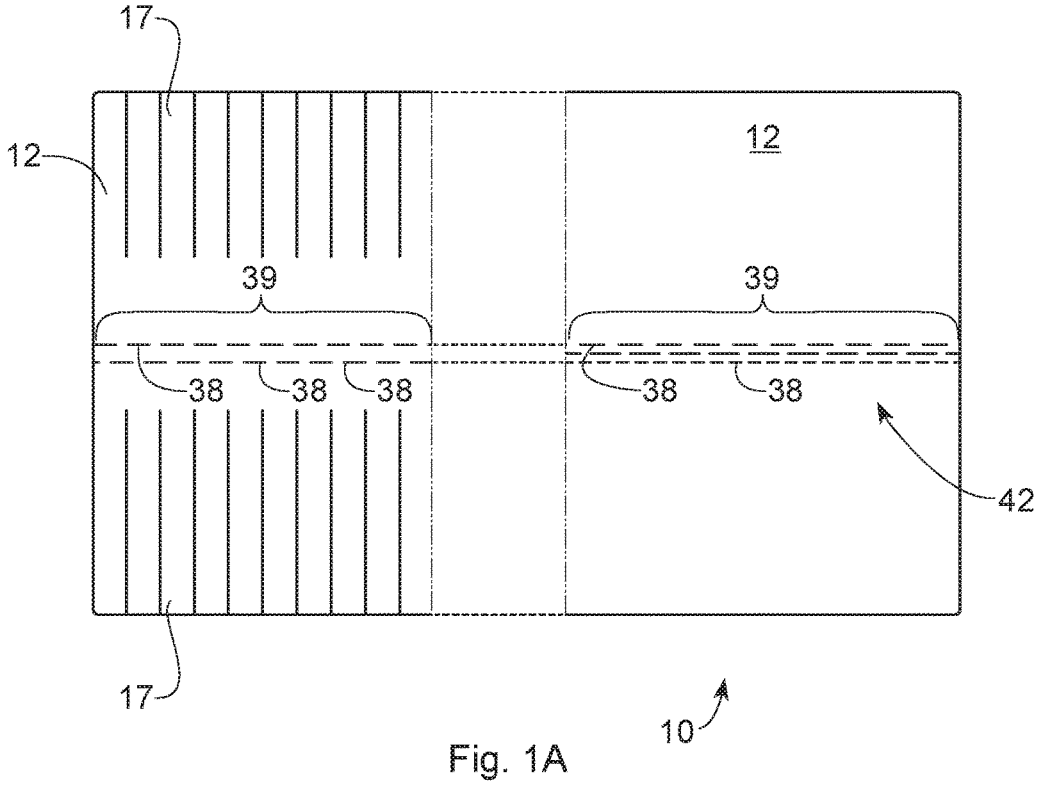
FIG. 1A is a broken top plan view of an exemplary cleaning article according to the present invention having one portion with gather strips and one portion without, and showing bonds having constant pitch and variable pitch, constant length and variable length, constant overlap and variable overlap, the optional sleeves being omitted for clarity.

Referring to FIG. 1A, the bond(s) 38 may be formed by adhesive bonding, thermal bonding, ultrasonic bonding, etc. In thermal bonding and ultrasonic bonding, energy and compressive pressure are applied to local bond 38 sites. The synthetic sheet 12 and synthetic tow fibers 14 are melted at such local sites. Upon refreezing, the local materials of sheet 12 and tow fibers 14 are refreeze together at such local sites, forming localized welds which are the bonds 38.

In a rotary ultrasonic bonding manufacturing system, an anvil which forms the seal 39 may be disposed on the periphery of an axially rotatable drum. The shape of the anvil dictates the shape of the corresponding seal 39. In a rotary ultrasonic system, the longitudinal axis LA of the seal 39 may be disposed in parallel to the axis of the rotating drum, i.e. perpendicular to the direction of rotation. Such anvil is briefly presented to an ultrasonic horn once during each rotation of the drum.

Energy from the horn is presented across the length of the drum, as taken in the axial direction. The energy is distributed throughout the axial length of the anvil, as taken in the direction of the seal 39 longitudinal axis LA. If the energy is distributed across too much anvil length, a proper seal 39 may not occur. If a proper seal 39 does not occur, it may be necessary to slow the anvil rotation, resulting in undesirable reduced line speed. And if the entire anvil length is presented to the horn at once, a greater energy shock occurs to the manufacturing system.

A single, longitudinally oriented, continuous bond according to the prior art exacerbates this situation. According to the prior art, the entire length of the bond area is presented to the horn at once, maximizing instantaneous energy draw. The present invention unexpectedly overcomes this problem by spreading the energy draw in the circumferential direction of drum rotation, thereby increasing the associated time period over which the anvil is presented to the horn.

This arrangement and associated process reduce energy spikes, providing for increased line speed and better seal 39 quality than achieved with the prior art. These improvements in line speed and seal 39 quality are unexpected, as the total bond area of the anvil actually increases according to the present invention when compared to the known art. But the manner and/or geometry of the increase provide the unpredicted benefit.

The sheet 12, fibrous layer 14 and non-planar structure may be bonded in a pattern which provides a central spine 42 parallel the longitudinal axis LA. The central spine 42 may bond through all layers of the cleaning article 10, including one or more sheets 12 and/or one or more fibrous layers 14. This arrangement provides the benefit that all components of the article 10 are joined at a common point in the manufacturing process.

A single continuous spine 42, which extends without interruption between the longitudinal edges of the cleaning article 10 is outside the scope of the present invention. It has proven difficult in manufacturing to maintain even heating throughout the typical length of a continuous spine comprising a single bond. The high aspect ratio and relatively great length of a single continuous bond 38 make it difficult to control the thermal and particularly the ultrasonic bonding processes.

If an ultrasonic bonding process is selected, one of skill may wish to limit the compressive force and ultrasonic energy used in the manufacturing process. By using discrete bonds 38 according to the present invention, it is prophetically believed that the energy from the ultrasonic horn may be applied to achieve better, more reliable bonds at line speeds previously achieved in the art or may be applied to achieve increased line speeds. Both options are unexpected in view of the known art. Without being bound by theory, it is believed these benefits occur because only a limited portion of the seal pattern is energized at any point in time.

Examining the spine 42 in more detail, the spine 42 comprises a plurality of discrete, individual bonds. Each bond 38 may be generally elongate, and may have a major axis parallel the longitudinal direction. A plurality of bonds 38 may be juxtaposed to form a seal 39. As used herein a seal 39 refers to a plurality of bonds 38 cooperating to join all tow fibers 14 within the longitudinal extent of the seal 39 to a sheet 12. A seal 39 may comprise plural rows of bonds 38, which row may be macroscopically parallel.

Referring to FIGS. 2, 3A-3D, the bonds 38 may be of like or different geometries. For example, the bonds 38 may be smaller in the longitudinal and/or transverse directions as the longitudinal edges of the cleaning article 10 are approached. If the bonds 38 are of like geometries, the bonds 38 will overlap in the longitudinal direction if the longitudinal dimension of the bonds 38 is greater than the longitudinal pitch between bonds 38. Successive bonds 38 may be offset in the transverse dimension, to preserve spacing therebetween.

Each bond 38 may overlap an adjacent bond 38 in the longitudinal direction. If an individual bond 38 is long enough in the longitudinal direction, and the longitudinal pitch small enough such bond 38 may overlap one, two or more bonds 38 in the longitudinal direction. Longitudinal overlap of each bond 38 with an adjacent bond 38 advantageously prevents longitudinal spaces therebetween. The longitudinal spaces, if present, would allow tow fibers 14 in those spaces to dislodge, freely come loose and become debris before, during or after the cleaning task.

As used herein, a bond, or segment of a bond 38 is considered to be longitudinally or transversely oriented, respectively, if such segment has a major axis within +45 degrees or ±30 degrees of the longitudinal or transverse directions. Each bond 38 may further comprise two or more segments, a generally longitudinally oriented segment and a segment oriented in the transverse direction. The transverse segment of a bond 38 may transversely overlap a segment of an adjacent bond, or an entire adjacent bond.

Two or more longitudinally adjacent bonds 38 may form a repeating unit 55. As used herein, a repeating unit 55 is the smallest longitudinal collection of bonds 38 which occurs in the longitudinal direction, and defines the pitch of the bonds 38. A repeating unit 55 may comprise a single bond 38 and the complementary, longitudinally inboard portions of two adjacent bonds 38.

According to the present invention a longitudinally oriented line through any repeating unit 55 intercepts the bonds 38 of that repeating unit in at least one position. In another embodiment, a longitudinally oriented line through any repeating unit 55 intercepts the bonds 38 of that repeating unit in at least two positions. In another embodiment, a longitudinally oriented line through any repeating unit 55 intercepts the bonds 38 of that repeating unit 55 in three or more positions. Without being bound by theory, it is believed that having all transverse lines through the spine 42 intercept the bonds 38 of the repeating unit 55 in two or more places provides for secure joining of the tow fiber layer 14 to the sheet 12.

The two places where a single transverse line intercepts longitudinally overlapping bonds 38 may provide for mutually unequal joining of the respective fibers 12 to the sheet 14. Thus the same fiber 14 may intercept one bond 38 generally parallel to the width direction of a first bond 38 and the same fiber 14 intercept a second bond 38 in a manner more aligned with the length direction of that bond 38.

This geometry, coupled with the longitudinal overlap of adjacent bonds 38, provides for a serpentine jog in the generally transverse tow fibers 14. The serpentine jog has a transversely oriented leg 50 between adjacent bonds 38 forming the seal 39 of the spine 42. Without being bound by theory, it is believed this serpentine jog having the intermediate transverse leg 50 provides for secure joining of the tow fibers 14 to the sheet 12 at the position of the spine 42.

The seal 39 at the spine 42 may extend the entire longitudinal dimension of the cleaning article 10 having both a sheet 12 and fiber layer 14 in superposed laminate relationship. Each discrete bond 38 forming the seal 39 may have a longitudinal dimension of 5 to 15 mm, or 8 to 12 mm. The bonds 38 may have a transverse dimension, or width, of 1 to 10 mm, 2 to 8 mm, or 2 to 5 mm. The bonds 38 may be spaced on a longitudinal pitch of 3 to 18 mm, 6 to 15 mm or 9 to 12 mm.

Figure 2:
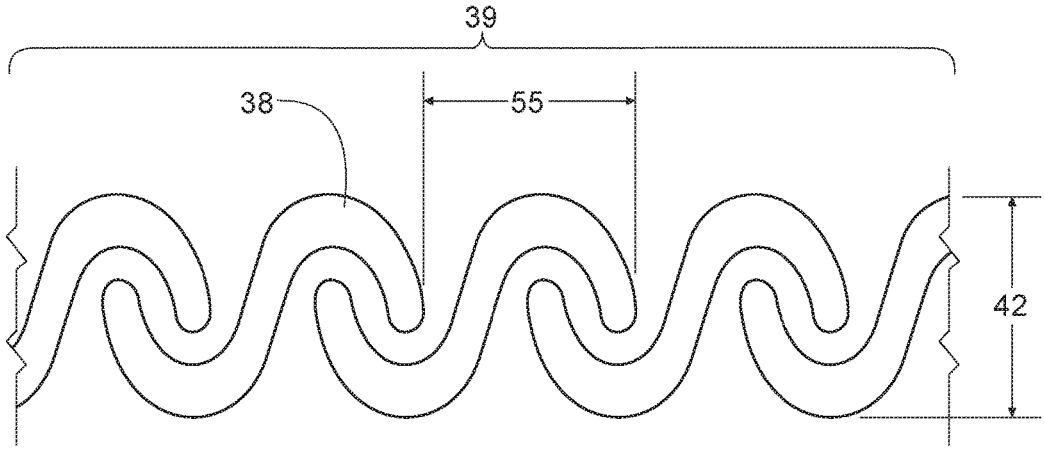
FIG. 2 is a top fragmentary plan view of one embodiment of a serpentine seal according to the present invention.
Figure 3A:
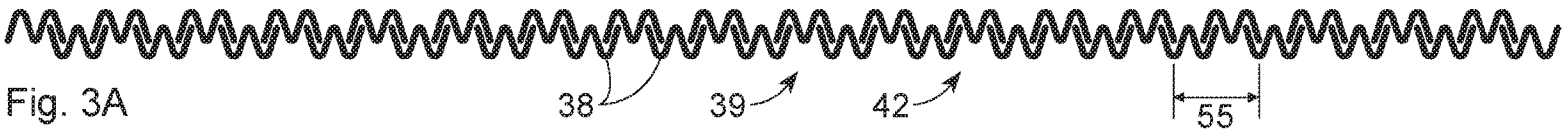
FIGS. 3A-3D are top fragmentary plan views of alternative embodiments of a seal according to the present invention.
Figure 3B:
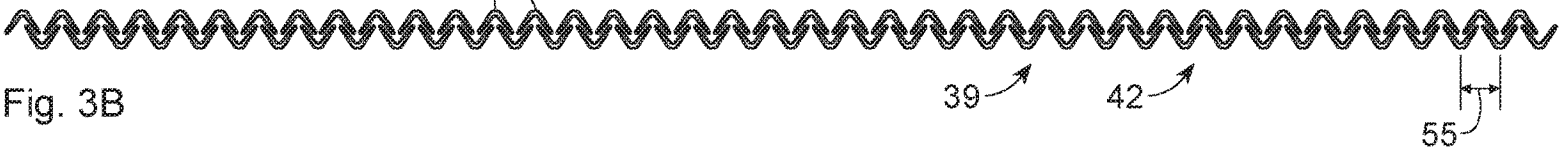
Figure 3C:
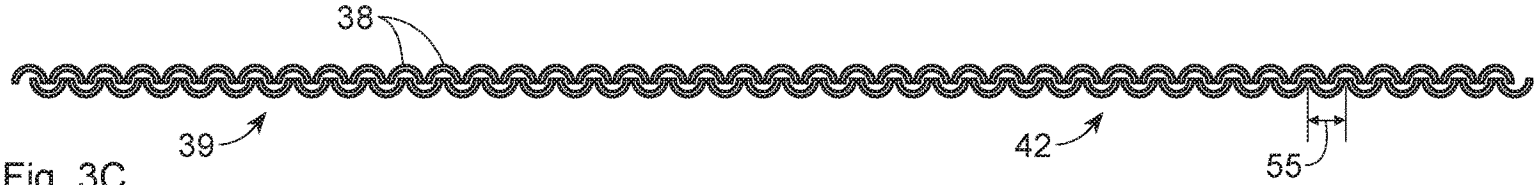
Figure 3D:
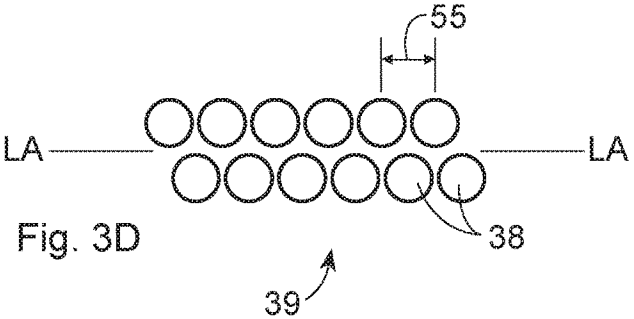
Figure 4A:
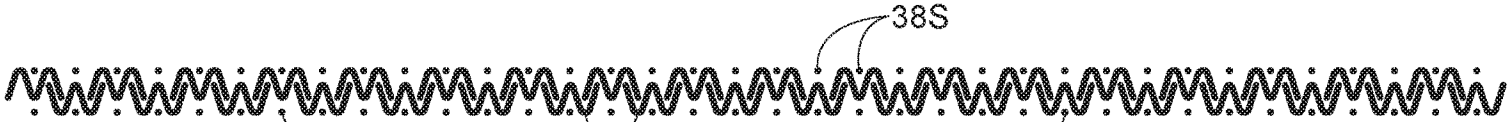
FIGS. 4A-4D are top fragmentary plan views of variant embodiments of the seals of FIGS. 3A-3D, respectively, and further comprising a spot bond.
Figure 4B:
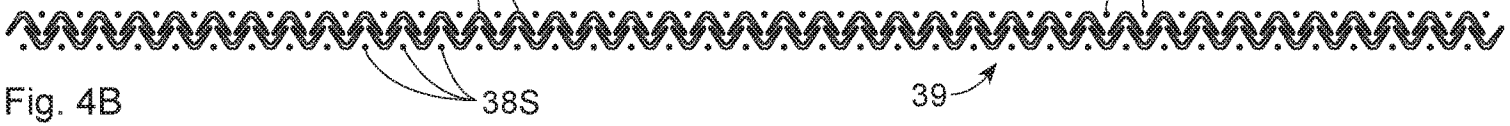
Figure 4C:
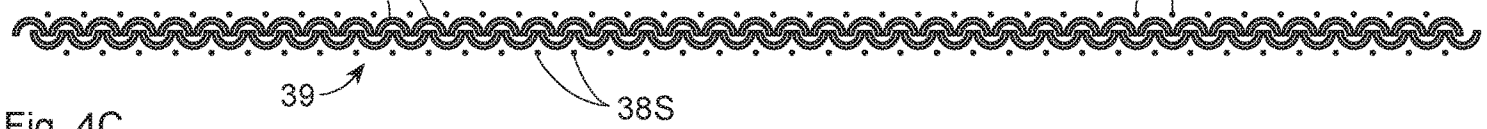
Figure 4D:
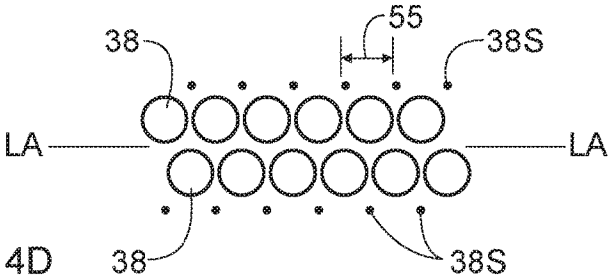

Referring to FIGS. 2-3D, an individual bond 38 may be thought of as having a length and width. The length, taken in the longitudinal direction may define an S-shaped, serpentine, sinusoidal, V-shaped, C-shaped, capital I-shaped, a simple straight line, a straight line oriented in the longitudinal direction, or other shape of bond 38 which allows for successive bonds 38 to intercept in both the longitudinal direction and transverse direction. Individual bonds 38 may be identical or different.

The width of an individual bond 38 is generally perpendicular to the length along any portion of the length. Without being bound by theory, it is believed that fibers 14 may benefit from having generally equivalent bonding, as taken in the transverse direction. If too little bonding occurs in the traverse direction, fibers may 14 become loose, leading back to the problems cited above. If too much bonding occurs in the traverse direction, the seal 39 may burn through the sheet 12 and/or excessive energy may be required.

Accordingly, Referring to FIGS. 4A-4D, if desired, the seal 39 may further comprise individual spot bonds 38S. The spot bonds 38S may be strategically placed in the longitudinal direction to align with portions of the other bonds 38 which would otherwise only intercept the fibers 14 at a single point, which point is generally parallel to the width direction of the seal 39.

The spot bonds 38S may also be used to equalize, or at least reduce differences between, the energy applied to the seal 39 at any point in time. The bonds 38 may present a variable surface area to the horn at any point in time. But the spot bonds 38S, in conjunction with the bonds 38, may total an area comparable to the area of the bonds 38, taken alone, for certain lines parallel to the longitudinal axis LA.

The joining of the tow fiber layer 14 and generally planar sheets 12 may be done with any suitable combination of bonds 38. Such bonds 38 may also be used to create sleeves 30 for the attachment system as discussed herein. Particularly the bonding pattern joining the two or more sheets 12 may be provided in a pattern which provides a sleeve 30 complementary to and able to receive the a singular tine 36 or plural tines 36 of the handle 35, if used with the cleaning article 10 of the present invention. Particularly, these bonds 38 may be provided in a pattern which is generally longitudinally oriented, so that the tines 36 may be longitudinally inserted into the sleeve 30 created between adjacent bonds 38.

One of skill will recognize that hybrids and combinations of the embodiments described above are contemplated and feasible. For example, a single cleaning article 10 may comprise plural sheets 12 and/or fiber layers 14 having seals with identical, similar and/or different geometries and/or a particular seal 39 may comprise bonds 38 having identical, similar and/or geometries. For example, the spine 42 may comprise bonds 38 and/or a seal 39 of a first geometry according to the present invention. The sleeves 30 may comprise bonds 38 and/or a seal 39 of the first geometry and/or of a second geometry, either or both made according to the present invention. Yet the same or different geometry[ies] may be used for additional bonds 38 transversely outboard of the sleeves 30.

Referring back to FIG. 1, any of the sheet 12 and/or layer of tow fibers 14 may be completely or partially coated with adhesive, wax, Newtonian or non-Newtonian oils or a combination thereof, in order to improve cleaning and increase retention of absorbed debris. If desired, the cleaning article 10 may optionally be used with a cleaning solution or other solution usable for other purposes such as treating the surface for appearance or disinfectant, etc. The cleaning solution may be pre-applied to the cleaning article 10, creating a pre-moistened cleaning article 10 or may be contained within a separate reservoir for dosing onto the cleaning article 10 and/or target surface. The cleaning solution may comprise a majority water, and at least about 0.5, 2, 5 or 10% solids, or at least about 30% or 50% aqueous solvents, non-aqueous solutions or mixtures thereof (all by weight).

If desired, various cleaning articles 10 described herein may be packaged and sold in a kit. This arrangement provides the benefit that the user has a choice of different cleaning articles 10 for different tasks. For example, if desired, plural sizes of the cleaning articles 10 may be sold together as a kit. This arrangement allows the user to select the particular cleaning article 10 best suited for the immediate task.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A cleaning article having a longitudinal axis and a transverse direction orthogonal thereto, said cleaning article comprising:

at least one sheet, at least one layer of tow fibers joined to said sheet at a seal to form a laminate, said tow fibers generally extending in the transverse direction, and a repeating unit, said seal comprising a plurality of adjacent, successive discrete bonds collectively extending in a generally longitudinal direction to form a spine, said discrete bonds at least partially overlapping adjacent bonds in both the longitudinal direction and the transverse direction, so that each said tow fiber is joined to said sheet by at least one said discrete bond, wherein said bonds are spaced on a longitudinal pitch of 3 to 18 mm and said bonds are serpentine shaped, wherein each said bond of said seal has an identical longitudinal length and identical longitudinal pitch between adjacent bonds, said length being greater than said pitch, wherein each said bond has a width, said length being greater than said width, wherein a plurality of said bonds are substantially identical in size and shape, wherein a longitudinally orientated line through the repeating unit intercepts the discreet bonds the repeating unit in at least two positions.

2. A cleaning article according to claim 1 wherein said seal comprises two rows of bonds, wherein said bonds in each row interlock with adjacent bonds.

3. A cleaning article according to claim 1 wherein said spine is juxtaposed with said longitudinal axis and further comprising two rows of bonds outboard of said spine, with one said row being disposed on each side thereof, forming two sleeves suitable for removably receiving at least one fork tine of a handle.

4. A cleaning article according to claim 1 wherein said spine is juxtaposed with said longitudinal axis and further comprising two rows of bonds outboard of said spine, with one said row being disposed on each side thereof, forming two sleeves suitable for removably receiving at least one fork tine of a handle.

5. A cleaning article having a longitudinal axis and a transverse direction orthogonal thereto, said cleaning article comprising:

at least one sheet, at least one layer of tow fibers joined to said sheet at a seal to form a laminate, said tow fibers generally extending in the transverse direction, and a repeating unit, said seal comprising a plurality of discrete bonds collectively extending in a generally longitudinal direction, said discrete bonds overlapping in the longitudinal direction, whereby each said tow fiber is joined to said sheet by at least one said discrete bond, a plurality of said bonds having at least one segment oriented in the transverse direction, wherein said bonds are spaced on a longitudinal pitch of 3 to 18 mm and said bonds are serpentine shaped, wherein each said bond of said seal has an identical longitudinal length and identical longitudinal pitch between adjacent bonds, said length being greater than said pitch, wherein each said bond has a width, said length being greater than said width, wherein a plurality of said bonds are substantially identical in size and shape, wherein a longitudinally orientated line through the repeating unit intercepts the discreet bonds the repeating unit in at least two positions.

6. A cleaning article according to claim 5 wherein said bonds have a length and a width perpendicular thereto, said length being greater than said width.

7. A cleaning article according to claim 5 wherein said bonds are C-shaped or V-shaped.

8. A cleaning article according to claim 7 wherein said bonds are concave towards said longitudinal centerline.

9. A cleaning article according to claim 8 wherein said bonds do not overlap said longitudinal centerline.

10. A cleaning article according to claim 9 wherein said bonds are interlaced.

11. A cleaning article having a longitudinal axis and a transverse direction orthogonal thereto, said cleaning article comprising:

at least one sheet, at least one layer of tow fibers joined to said sheet at a seal to form a laminate, said tow fibers generally extending in the transverse direction, and a repeating unit, said seal comprising a plurality of successive discrete bonds collectively extending in a generally longitudinal direction to form a spine, said seal comprising two generally longitudinal rows of discrete bonds, each said bond having a length and a width perpendicular thereto, said discrete bonds at least partially overlapping adjacent bonds in the longitudinal direction, so that each said tow fiber is joined to said sheet by at least one said discrete bond, wherein said bonds are spaced on a longitudinal pitch of 3 to 18 mm and said bonds are serpentine shaped, wherein each said bond of said seal has an identical longitudinal length and identical longitudinal pitch between adjacent bonds, said length being greater than said pitch, wherein each said bond has a width, said length being greater than said width, wherein a plurality of said bonds are substantially identical in size and shape, wherein a longitudinally orientated line through the repeating unit intercepts the discreet bonds the repeating unit in at least two positions.

12. A cleaning article according to claim 11 wherein each said tow fiber is joined to said sheet by at least two said discrete bonds.

13. A cleaning article according to claim 11 wherein said bonds transversely overlap, so that a single fiber intercepting two bonds is bonded to a different length or width of each of said two bonds.

14. A cleaning article according to claim 11 wherein said seal comprises at least two longitudinally oriented rows of said bonds, at least a portion of said bonds in each said row being disposed on opposite sides of said longitudinal axis.

15. A cleaning article according to claim 11 wherein said seal comprises two rows of bonds, one said row being disposed on each side of said longitudinal axis.

* * * * *